US011272734B2

(12) United States Patent
Grandjean et al.

(10) Patent No.: US 11,272,734 B2
(45) Date of Patent: Mar. 15, 2022

(54) SMOKING ARTICLE MOUTHPIECE CONFIGURED TO RECEIVE AN INSERT UNIT

(71) Applicant: PHILIP MORRIS PRODUCTS S.A., Neuchatel (CH)

(72) Inventors: Emeric Grandjean, Lausanne (CH); Stephane Jeantet, Mignovillard (FR); Leonardo Nappi, Vallamand (CH)

(73) Assignee: Philip Morris Products S.A., Neuchatel (CH)

( * ) Notice: Subject to any disclaimer, the term of this patent is extended or adjusted under 35 U.S.C. 154(b) by 336 days.

(21) Appl. No.: 16/495,886

(22) PCT Filed: Mar. 29, 2018

(86) PCT No.: PCT/EP2018/058222
§ 371 (c)(1),
(2) Date: Sep. 20, 2019

(87) PCT Pub. No.: WO2018/185014
PCT Pub. Date: Oct. 11, 2018

(65) Prior Publication Data

US 2020/0022405 A1 Jan. 23, 2020

(30) Foreign Application Priority Data

Apr. 3, 2017 (EP) ..... 17164646

(51) Int. Cl.
*A24D 3/18* (2006.01)
*A24D 3/10* (2006.01)
(Continued)

(52) U.S. Cl.
CPC ..... *A24D 3/04* (2013.01); *A24D 3/061* (2013.01); *A24D 3/08* (2013.01); *A24D 3/10* (2013.01); *A24D 3/18* (2013.01); *A24D 3/17* (2020.01)

(58) Field of Classification Search
None
See application file for complete search history.

(56) References Cited

U.S. PATENT DOCUMENTS 5,947,126 A 9/1999 Wilson
9,332,786 B2 5/2016 Yokogawa
(Continued)

FOREIGN PATENT DOCUMENTS

CA 2961106 2/2016
CN 101232825 7/2008
(Continued)

OTHER PUBLICATIONS

PCT Search Report and Written Opinion for PCT/EP2018/058222 dated May 31, 2018 (9 pages).
(Continued)

*Primary Examiner* — Dennis R Cordray
(74) *Attorney, Agent, or Firm* — Mueting Raasch Group

(57) ABSTRACT

A smoking article (10) comprising: an aerosol-generating substrate (12) and a mouthpiece (14) secured to a downstream end of the aerosol-generating substrate (12). The mouthpiece (14) comprises a first segment (24) of elastically deformable material, the first segment (24) having a length in the longitudinal direction of the mouthpiece (14) and a width transverse to its length. The first segment (24) comprises an insert unit access portion comprising at least one slit (60) extending along at least a part of the length of the first segment (14), and extending across at least a part of the width of the first segment (14) to facilitate deformation of
(Continued)

the access portion, such that an opening (25) is formable or expandable in the access portion of the first segment (14) upon receiving an insert unit (50).

15 Claims, 4 Drawing Sheets

(51) Int. Cl.

| | |
|---|---|
| ***A24D 3/04*** | (2006.01) |
| ***A24D 3/06*** | (2006.01) |
| ***A24D 3/08*** | (2006.01) |
| ***A24D 1/14*** | (2006.01) |
| *A24D 3/17* | (2020.01) |

(56) References Cited

U.S. PATENT DOCUMENTS

| | | | | |
|---|---|---|---|---|
| 9,497,991 | B2 | 11/2016 | Besso | |
| 9,565,874 | B2 | 2/2017 | Kaljura | |
| 10,736,351 | B2 | 8/2020 | Kaihatsu | |
| 2008/0230079 | A1 | 9/2008 | Besso | |
| 2012/0260928 | A1 | 10/2012 | Herholdt | |
| 2013/0081644 | A1 | 4/2013 | Noda | |
| 2014/0332014 | A1* | 11/2014 | Penrose | A24D 3/061 131/274 |
| 2014/0345634 | A1* | 11/2014 | Zuber | A24D 1/20 131/329 |
| 2015/0292878 | A1 | 10/2015 | Mucalo | |
| 2018/0000152 | A1 | 1/2018 | Ito | |
| 2019/0000134 | A1* | 1/2019 | Lavanant | A24D 3/061 |

FOREIGN PATENT DOCUMENTS

| | | |
|---|---|---|
| CN | 101578053 | 11/2009 |
| CN | 102711532 | 10/2012 |
| CN | 102821632 | 12/2012 |
| CN | 103732089 | 4/2014 |
| CN | 104363779 | 2/2015 |
| CN | 104869854 | 8/2015 |
| EP | 2856891 | 4/2021 |
| GB | 1333434 | 10/1973 |
| GB | 1373768 | 11/1974 |
| RU | 2564600 | 10/2015 |
| WO | WO 2007/060543 | 5/2007 |
| WO | WO 2011/152316 | 12/2011 |
| WO | WO 2012/156689 | 11/2012 |
| WO | WO 2013/000967 | 1/2013 |
| WO | WO 2015/135723 | 9/2015 |
| WO | WO 2016/147246 | 9/2016 |
| WO | WO 2016/181843 | 11/2016 |
| WO | WO 2017/009298 | 1/2017 |
| WO | WO 2018/007561 | 1/2018 |

OTHER PUBLICATIONS

Office Action issued in China for Application No. 201880017070.4 dated Jun. 3, 2021 (12 pages). English translation included.
Office Action issued in Russia for Application No. 2019135063/03 dated Jul. 23, 2021 (18 pages). English translation included.

* cited by examiner

SMOKING ARTICLE MOUTHPIECE CONFIGURED TO RECEIVE AN INSERT UNIT

This application is a U.S. National Stage Application of International Application No. PCT/EP2018/058222 filed Mar. 29, 2018, which was published in English on Oct. 11, 2018, as International Publication No. WO 2018/185014 A1. International Application No. PCT/EP2018/058222 claims priority to European Application No. 17164646.6 filed Apr. 3, 2017.

The present invention relates to a smoking article configured to receive an insert unit at its downstream end. The invention is particularly applicable to filter cigarettes configured to receive a frangible capsule at their downstream end.

Filter cigarettes are one example of smoking articles. Filter cigarettes typically comprise a rod of tobacco cut filler surrounded by a paper wrapper and a cylindrical filter aligned in end-to-end relationship with the wrapped tobacco rod, with the filter attached to the tobacco rod by tipping paper. In conventional filter cigarettes, the filter may consist of a plug of cellulose acetate tow wrapped in porous plug wrap. Filter cigarettes with multi-component filters that comprise two or more segments of filtration material for the removal of particulate and gaseous components of the mainstream smoke are also known.

A number of smoking articles in which an aerosol forming substrate, such as tobacco, is heated rather than combusted have also been proposed in the art. In heated smoking articles, the aerosol is generated by heating the aerosol forming substrate. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool, they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

It is known to incorporate additives, such as flavourants, into smoking articles in order modify the smoking experience for a consumer. One known way to incorporate additives, such as flavourants, into a smoking article is in the form of a crushable capsule. The capsules typically comprise a frangible wall enclosing a liquid additive. A consumer can apply a force to the capsule to rupture the wall and thus release the additive, thereby allowing a consumer to modify their smoking experience.

However, such capsules are incorporated into a smoking article during manufacture, for example, by embedding them in a segment of fibrous filtration material, such as cellulose acetate tow. Consequently, a consumer is restricted to using additives that are already provided as part of the manufactured smoking article.

WO2013000967 A1 describes a filter having a mouth end recess that is configured to receive and retain a complementary-shaped insertable filter unit. If a capsule is to be inserted into the mouth end recess, the capsule needs to be first embedded in plug of filtration material, with said plug then being inserted into the recess. The plug is compressed during insertion to form a snug fit within the recess, so as to retain the plug therein.

It would therefore be desirable to improve the manner by which a consumer can customise their smoking experience, and in particular, customise the type of additive or flavour that they can use when smoking a smoking article.

According to a first aspect of the invention, there is provided a smoking article for receiving an insert unit, the smoking article comprising: an aerosol-generating substrate and a mouthpiece secured to a downstream end of the aerosol-generating substrate, the mouthpiece comprising: a first segment of elastically deformable material, the first segment having a length in the longitudinal direction of the mouthpiece and a width transverse to its length. The first segment comprises an insert unit access portion comprising at least one slit extending along at least a part of the length of the first segment, and extending across at least a part of the width of the first segment to facilitate deformation of the access portion, such that an opening is formable or expandable in the access portion of the first segment upon receiving an insert unit.

According to an aspect of the invention, there is provided a smoking article for receiving an insert unit, the smoking article comprising: an aerosol-generating substrate and a mouthpiece secured to a downstream end of the aerosol-generating substrate, the mouthpiece comprising: a first segment of elastically deformable material, the first segment having a length in the longitudinal direction of the mouthpiece and a width transverse to its length. The first segment comprises an insert unit access portion comprising at least one slit extending along at least a part of the length of the first segment, and extending across at least a part of the width of the first segment to facilitate deformation of the insert unit access portion, between: an undeformed state, in which the boundary of the at least one slit does not define an opening in the insert unit access portion; and a deformed state, in which the boundary of the at least one slit defines at least a portion of the periphery of an opening in the insert unit access portion upon receiving an insert unit.

The provision of a first segment having an access portion comprising the at least one slit enables a consumer to incorporate an insert unit into the mouthpiece of the smoking article, after the smoking article has been manufactured and supplied to the consumer. The insert unit can be configured to modify at least one characteristic of the smoking article. Consequently, the consumer is able to customise their smoking experience by selecting whether or not to introduce one or more insert units into the mouthpiece of the smoking article.

Furthermore, unlike prior art recess filters such as those of WO2013000967 A1, the first segment of the present invention comprises at least one slit extending along at least a part of the length of the first segment, and extending across at least a part of the width of the first segment. The slit is provided to facilitate elastic deformation of the first segment at the access portion between an undeformed state and a deformed state. Such deformation enables an opening to be formed or expanded in the access portion of the first segment when an insert unit is being inserted into the first segment. That is, the act of inserting an insert unit into the access portion of the first segment causes the elastically deformable material of the segment either side of the slit to be deflected and thus create an opening or expand an existing opening at the access portion through which the insert unit can pass so that it becomes inserted into the mouthpiece.

In a first set of preferred embodiments, insertion of the insert unit may ultimately result in the insert unit residing within the first segment of the mouthpiece. In such circumstances, the elastically deformable material about the access portion will act to retain the insert unit in place within the first segment. Through an appropriate choice of elastically deformable material and an appropriate configuration of the access portion, the insert unit can be easily inserted, and reliably retained, in the first segment of the mouthpiece without a great risk of damaging the insert unit. For example, preferably the at least one slit extends in the longitudinal direction of the first segment by at least 40 percent of the length of the first section, more preferably at least 60 percent. This can help the insert unit to be inserted sufficiently far along the length of the first segment, such that the portions of the at least one slit located downstream of the insert unit are no longer significantly affected by the presence of the insert unit and can therefore substantially return to their original state, to reliably retain the insert unit in position within the first segment.

Alternatively, in a second set of preferred embodiments, the mouthpiece further comprises a second tubular segment adjacent to and upstream of the first segment, wherein the second tubular segment is a hollow tubular segment and defines a chamber for receiving the insert unit. In such embodiments, insertion of the insert unit can ultimately result in the insert unit passing all the way along the longitudinal length of the formed or expanded opening of the first segment, until it reaches and resides within the chamber of the second hollow tubular segment of the mouthpiece. In such embodiments, the insert unit can also be easily inserted, and reliably retained, within mouthpiece without a great risk of damaging the insert unit. This is because the at least one slit can help the access portion of the first segment to better deform into its deformed state as the insert unit passes through the formed or expanded opening, and thus prevent the elastically deformable material of the first segment from imposing too large a resistive or compressive force on the unit as it is being inserted. However, once the insert unit has passed through the opening of the first segment and resides in the chamber of the second hollow tubular element, the first segment can elastically revert to its previous (undeformed) state to provide a barrier that prevents or inhibits the insert unit from exiting the mouthpiece. In particular, the access portion of the first segment can elastically revert from its deformed state to an undeformed state that results in there no longer being an opening in the first segment, or to an undeformed state where an existing opening in the first segment has a cross-section area that does not fully encompass the cross sectional area of the insert unit contained within the chamber. Namely, after the insert unit has passed through the first segment, the portion of the first segment defined by the at least one slit reverts from its deformed state to its previous undeformed state such that the at least one slit exhibits its previous narrow profile. This ensures that there is at least a partial enclosure surface at the downstream end of the chamber, which can prevent the insert unit from exiting the chamber. Consequently, the insert unit is retained within the chamber and prevented from exiting the mouthpiece.

The present invention is particularly suited to use with fragile insert units, such a frangible capsules, which are configured to break or rupture when subjected to an external force. When used with such insert units, the arrangement of at least one slit in the first segment can ensure that the capsule is not subjected to too high a compressive force (and thus undesirably ruptured) as it is being inserted into the smoking article mouthpiece.

Accordingly, the present invention provides a reliable and effective way for enabling a consumer to insert an insert unit into the mouthpiece of a smoking article, without a great risk of damaging the insert unit during insertion. The present invention also provides a reliable and effective way for retaining the insert unit in the mouthpiece of the smoking article after it has been inserted. A consumer can therefore conveniently customise their smoking experience by selecting whether or not to introduce one or more insert units to the mouthpiece of the smoking article.

The first segment has an access portion that is configured to receive an external insert unit. Therefore, preferably, the first segment is disposed at the downstream end of the mouthpiece. Put another way, preferably the first segment defines the downstream end face of the mouthpiece.

Alternatively, the mouthpiece may comprise a portion downstream of the first segment. In such embodiments, the portion downstream of the first segment should be configured to allow for an insert unit to pass from the exterior of the mouthpiece to the access portion of the first segment. The portion downstream of the first segment may therefore consist of one or more hollow tubular segments. Alternatively or additionally, the portion downstream of the first segment may consist of a mouth end cavity formed by one or more wrappers extending downstream of the first segment.

As noted above, the at least one slit of the first segment is provided to facilitate deformation of the access portion, such that an opening is formable or expandable in the access portion of the first segment upon receiving an insert unit. Therefore, in its broadest sense, the present invention covers arrangements in which there is effectively no existing opening in the access portion, and the opening is only formed by the presence of the at least one slit and the action of inserting an insert unit into the first segment. The present invention also covers arrangements in which a pre-formed opening already exists in the first segment as part of the access portion, and said pre-formed opening is able to be expanded by the presence of the at least one slit and the action of inserting an insert unit into the first segment.

Accordingly, in one set of preferred embodiments, the access portion of the first segments consists solely of the at least one slit. In such embodiments, the at least one slit is configured to facilitate deformation of the access portion, such that an opening is formed at the access portion of the first segment upon receiving an insert unit. For example, in its simplest form, the first segment may consist of a single slit and the opening is defined by the boundary of the single slit, which becomes stretched or distorted when the insert unit is being inserted into the mouthpiece. Accordingly, when the first segment is its undeformed state, there is effectively no opening or an infinitesimally small sized opening defined solely by the slit itself. However, when an insert unit is passed through or into the first segment, the slit facilitates deformation of the access portion to cause an opening to be created and expanded, and thus allow the insert unit to pass into the first segment without imposing too large a resistive or compressive force on the insert unit. In such circumstances, the perimeter of the opening will be defined solely by the boundaries of the slit itself.

As another example, the access portion of the first segment may consist solely of a first slit and a second slit, where the second slit is preferably substantially perpendicular to the first slit. In such an example, preferably the first segment is substantially cylindrical, and each slit preferably extends along the path of a line passing through the centre of the first segment's substantially circular cross-section. In this example, when the access portion of the first segment is its undeformed state, there is effectively no opening or an infinitesimally small sized opening defined solely by the two slits. However, when an insert unit is passed through the first segment, the two slits facilitate deformation of the access portion to cause an opening to be created and expanded, and thus allow the insert unit to pass into the first segment without imposing too large a resistive or compressive force on the insert unit. In such circumstances, the perimeter of the opening will be defined solely by the boundaries of the two slits.

Arranging for the access portion of the first segment to be defined solely by the at least one slit, can provide a simple and effective way for facilitating insertion of the insert unit, whilst also preventing an inserted insert unit (or components thereof) from exiting the mouthpiece through its mouth end. In such embodiments, a second hollow tubular segment may be provided adjacent to and upstream of the first segment, to define a chamber in which the insert unit can reside after it has passed through the first segment. However, it may be more preferable to arrange for the insert unit to be retained in the first segment itself. This is because, once the insert unit has been inserted sufficiently far along the length of the first segment, the portions of the at least one slit disposed downstream of the insert unit (i.e. towards the mouth end) can revert to their original (undeformed) state to provide an effective barrier that prevents or inhibits the insert unit from exiting the mouthpiece.

As noted above, the present invention also covers arrangements in which a pre-formed opening already exists as part of the access portion of the first segment, and said pre-formed opening is able to be expanded by the presence of the at least one slit and the action of inserting an insert unit into the first segment. Accordingly, in one set of preferred embodiments, the access portion of the first segment comprises the at least one slit and a pre-formed opening extending along at least a part of the length of the first segment. That is, preferably, the first segment is a hollow tubular segment of elastically deformable material and the access portion of the first segment further comprises a pre-formed opening in the hollow tubular segment, and wherein the at least one slit extends across at least a portion of the width of the first segment from a point on the periphery of the pre-formed opening. In such embodiments, the mouthpiece preferably further comprises a second hollow tubular segment adjacent to and upstream of the first segment, to define a chamber in which the insert unit can reside after it has passed through the first segment. Preferably, the pre-formed opening and the at least one slit extend along the entire length of the first segment.

In embodiments where the first segment is a hollow tubular segment of elastically deformable material and the access portion further comprises a pre-formed opening in the hollow tubular segment, preferably, at least a portion of the first hollow tubular segment inwardly projects into the pre-formed opening to define at least one elastically deformable projection.

The at least one elastically deformable projection inwardly projects into the pre-formed opening, in order to reduce the amount of internal surface of the first hollow tubular segment that can come into contact with a filter unit as it passes through the first segment. This has an additional synergistic benefit, in that the projection can then act as a barrier that inhibits the unit from exiting mouthpiece.

The at least one elastically deformable projection may have any suitable profile as viewed from the downstream end of the smoking article or mouthpiece. In particular, the pre-formed opening can have a perimeter as viewed from the downstream end of the smoking article or mouthpiece. When viewed from the downstream end of the smoking article or mouthpiece, each projection of the first hollow tubular segment is delimited by a first portion of the perimeter and an imaginary straight line that intersects each end of the first portion of the perimeter. Preferably, the distance between the imaginary straight line and the point on the first portion of the perimeter furthest from the imaginary straight line, in a direction perpendicular to the imaginary straight line, is at least about 0.5 millimetre, preferably at least about 1 millimetre, more preferably, at least about 2 millimetres. Each projection may therefore have straight or curved side portions, as viewed from the downstream end of the smoking article or mouthpiece. Each projection may have a pointed or rounded tip, as viewed from the downstream end of the smoking article or mouthpiece.

Preferably, the at least one slit extends across at least a portion of the width of the first segment from a point on the periphery of the pre-formed opening defined by the tip of the at least one elastically deformable projection. For example, the first segment may comprise a first slit, a second slit, a first projection and a second projection, and the first slit may extend across at least a portion of the width of the first segment from a point on the periphery of the pre-formed opening defined by the tip of the first projection, and the second slit may extend across at least a portion of the width of the first segment from a point on the periphery of the pre-formed opening defined by the tip of the second projection.

Preferably, the shape of the pre-formed opening has at least one degree of bilateral symmetry as viewed from the downstream end of the smoking article or mouthpiece. Preferably, the shape of the pre-formed opening has radial symmetry as viewed from the downstream end of the smoking article or mouthpiece.

The first segment may have any suitable shape. Preferably, the first segment is substantially cylindrical. That is, preferably the first segment has a substantially circular cross-section. In such embodiments, preferably the at least one slit extends along at least a portion of a line passing through the centre of the first segment's substantially circular cross-section. This may help the access portion of the first segment to elastically deform about the at least one slit, as the insert unit passes through the first segment, and thus may help to reduce the compressive force that is applied by the first segment to the insert unit. This may also help the user to more accurately align an insert unit with the access portion of the first segment, either when using a device for inserting the insert unit or when directly inserting the unit with their fingers.

The access portion of the first segment may be provided with any suitable number of slits. For example, a single slit may only be provided. Alternatively, in some embodiments the access portion of the first segment has at least a first slit and a second slit.

In such embodiments, preferably the at least one slit in the first segment comprises a first slit and a second slit, and wherein the first slit extends across the width of the first segment along at least a portion of a first imaginary line, and the second slit extends across the width of the first segment along at least a portion of a second imaginary line, and wherein the first imaginary line intersects the second imaginary line at a location on the first segment. In such embodiments, preferably the first slit intersects with the second slit at the location on the first segment.

Preferably, the second slit is substantially perpendicular to the first slit.

Preferably, at least one slit extends along the entire length of the first segment, even more preferably all slits in the first segment extend along the entire length of the first segment.

The insert unit may be any component that can be inserted into a smoking article mouthpiece. Preferably, the insert unit is capable of altering at least one characteristic of the smoking experience. For example, the insert unit may comprise filtration material, and thus may reduce the quantity of certain constituents of the mainstream smoke or vapour passing through the mouthpiece. The insert unit may alter the flow of the mainstream smoke or vapour through the mouthpiece. For example, the mainstream smoke or vapour may preferentially flow through the insert unit or the insert unit may act as a flow restrictor. The insert unit in this case may have a higher or a lower resistance to draw than other components of the mouthpiece.

Preferably, the insert unit is configured to impart at least one flavour into the mainstream smoke or vapour passing through the mouthpiece. The insert unit may comprise, for example, a flavour bead or a flavour thread. However, preferably, the insert unit comprises a frangible capsule, more preferably a frangible flavour capsule.

The frangible capsule may be provided as part of the filter unit, for example, a frangible capsule embedded in a plug of filtration material. Alternatively, in some preferred embodiments, the insert unit consists solely of the frangible capsule.

The frangible capsule preferably comprises a frangible shell enclosing a payload comprising at least one additive capable of modifying the mainstream smoke or vapour passing through the mouthpiece. Preferably, the payload is a liquid payload.

If the first segment is a hollow tubular segment having at least one elastically deformable internal projection, then only a single projection may be provided. This can reduce the complexity of manufacturing the first hollow tubular segment.

Alternatively, in some preferred embodiments, the first hollow tubular segment comprises two or more elastically deformable projections that inwardly project into the pre-formed opening of the first hollow tubular segment. In such embodiments, preferably, two or more of the elastically deformable projections are uniformly disposed around the pre-formed opening. For example, the first hollow tubular segment may comprise two elastically deformable projections diametrically opposed around the pre-formed opening. As another example, the first hollow tubular segment may comprise three elastically deformable projections disposed around the pre-formed opening, with each projection being disposed at the tip of an imaginary equilateral triangle, as viewed from the downstream end face of the mouthpiece. This uniform distribution can enhance the effectiveness of the projections in allowing an insert unit to pass into the mouthpiece, and preferably into a chamber upstream of the first segment. The uniform distribution can also improve the effectiveness of the projections in retaining the insert unit in the mouthpiece after insertion. That is, the uniform distribution can allow for a more even distribution of the compressive force that is applied by the first segment to the insert unit, as the insert unit passes through the opening of the access portion of the first segment. This can further reduce the risk of damage to the insert unit as it is inserted into the mouthpiece. This is therefore particularly advantageous when the insert unit is fragile, such as a frangible capsule.

Preferably, the at least one projection delimits the shape of the pre-formed opening, as viewed from the downstream end of the smoking article or mouthpiece, such that the pre-formed opening cannot fully encompass a circle having a diameter of from about 2 millimetres to about 5 millimetres, more preferably about 3 millimetres to about 4 millimetres. Such circular diameters correspond to the diameters of a typical frangible capsule for a smoking article. Consequently, such a capsule could not pass through the pre-formed opening without first deforming a portion of the first hollow tubular segment.

Irrespective of whether at least a portion of the first segment inwardly projects into the pre-formed opening to define at least one elastically deformable projection, it is preferably for there to be a greater amount of space in the chamber of the second hollow tubular segment than that in the opening of the first segment, if a second hollow tubular segment is present. This helps to effectively retain an insert unit in the chamber of the second segment after it has passed through the opening of the access portion of the first hollow tubular segment.

Consequently, it is preferable for the cross sectional area of the pre-formed opening of the first segment to be less than the cross sectional area of the chamber of the second hollow tubular segment. This can help to create a step between the two segments that can assist in preventing the insert unit from exiting the chamber. Preferably, the central longitudinal axis of the mouthpiece extends through both the pre-formed opening of the first segment and the chamber of the second hollow tubular member.

This may be expressed in terms of an equivalent diameter (Deq.), which is the diameter of a circle having the same area as that of the shape of the pre-formed opening of the first hollow tubular segment. Therefore, preferably, the cross sectional area of the pre-formed opening of the first segment has an equivalent diameter (Deq.) of about 90 percent or less, more preferably about 70 percent or less, even more preferably about 60 percent or less than the equivalent diameter (Deq.) of the cross sectional area of the chamber of the second hollow tubular segment. The equivalent diameter (Deq.) can be calculated using the following formula:

$$Deq=2\times\sqrt{S\div\pi}$$

where S is the cross sectional area of the first segment at a given longitudinal position, and $\pi$ is the mathematical constant "pi". In the case of the first segment, S is the cross sectional area of the first segment at a longitudinal position where the at least one slit resides.

Preferably, the cross sectional area of the pre-formed opening of the first segment has an equivalent diameter (Deq.) of from about 1.8 millimetres to about 3.8 millimetres.

Preferably, the cross sectional area of the chamber of the second hollow tubular segment has an equivalent diameter (Deq.) of from about 2.5 millimetres to about 6.9 millimetres.

Preferably, the cross sectional area of the pre-formed opening of the first segment does not change along the longitudinal axis for the mouthpiece. In this case, preferably the slit extends along the entire length of the first segment. This may help to ease the manufacture of the first segment. Alternatively, in some embodiments the cross sectional area of the pre-formed opening of the first segment changes along the longitudinal axis for the mouthpiece. For example, the pre-formed opening of the first segment may taper, such that it has a smaller cross sectional area at one end of the first segment. As another example, the segment may comprise one or more of the projections discussed above, which may only reside along a certain longitudinal part or parts of the first segment.

If the mouthpiece comprises a second hollow tubular segment, the second hollow tubular segment may be the most upstream segment of the mouthpiece. In such embodiments, the second hollow tubular segment is directly adjacent to the downstream end of the aerosol generating substrate. However, preferably the mouthpiece further comprises a segment of filtration material adjacent to and upstream of the second hollow tubular segment. The segment of filtration material is preferably a plug of fibrous filtration material, such as a plug of cellulose acetate tow. This provides an upstream end face to the chamber of the second hollow tubular segment. Such an upstream segment of fibrous filtration material can be advantageous when the insert unit is a capsule having frangible shell enclosing a liquid payload. This is because the liquid payload can stick to the fibrous material after the capsule has been ruptured, and help to retain fragments of the capsules shell in the chamber. The segment of filtration material adjacent to and upstream of the second hollow tubular segment may also advantageously provide additional filtration to the mouthpiece, which may help to compensate for any lack of or low filtration that is provided downstream of said segment.

Preferably, the segment of filtration material has a different colour from the colour of the first hollow tubular segment. This can make it easier for a consumer to discern the perimeter of the opening in the first hollow tubular segment.

The mouthpiece may further comprise one or more wrappers circumscribing at least the first segment. The one or more wrappers may also circumscribe any additional segments that may be present, such as a second hollow tubular segment that is adjacent to and upstream of the first segment. In particularly preferred embodiments, the mouthpiece further comprises an impermeable wrapper circumscribing at least the first segment. The impermeable wrapper can be advantageous when the insert unit is a capsule having frangible shell enclosing a liquid payload. This is because the impermeable wrapper can prevent the liquid payload from seeping through to the exterior surface of the mouthpiece. The impermeable wrapper may comprises a substrate, such as a paper substrate, that is coated with a coating impermeable to liquid. Suitable coatings include, but are not limited to, nitrocellulose and ethyl-cellulose.

The first segment of the mouthpiece may be formed from any suitable elastically deformable material. For example, the first segment may be formed from foamed material or rubber.

Preferably, any aerosol generated by the aerosol-generating substrate can pass through the portion of the first segment formed by the elastically deformable material.

In preferred embodiments, the elastically deformable material of the first segment comprises a fibrous filtration material. The fibrous filtration material may comprise cellulose based fibers, such as cellulose acetate fibers. In such embodiments, the first hollow tubular segment may be understood to be a type of hollow acetate tube. Alternatively or additionally, the fibrous material may comprise polylactic acid fibers or crimped paper.

A plasticiser may be added to the fibrous filtration material to adjust the elastic properties of the first segment. Such plasticisers include triacetin, and triethylenglycol di-acetate. Where a plasticiser is included in the first segment, preferably the plasticiser is included in an amount of from about 5 percent weight to about 23 percent weight of the total weight of the first segment. In some preferred embodiments, the first segment comprises fibrous filtration material and a plasticiser added to the fibrous filtration material.

If the mouth piece further comprises a second hollow tubular segment comprising fibrous filtration material and a plasticiser added to the fibrous filtration material, the percentage weight content of the plasticiser in the first segment may be the same as the percentage weight content of the plasticiser in the second hollow tubular segment. However, preferably, the percentage weight content of the plasticiser in the first segment is less than the percentage weight content of the plasticiser in the second hollow tubular segment. This can advantageously allow the access portion of the first segment to be suitably deformable to enable an insert unit to be easily inserted into the chamber of the second hollow tubular segment, whilst also providing a stable surrounding for the insert unit once it has been received into the chamber. The second hollow tubular segment may be formed from any suitable material. Preferably, the second hollow tubular segment comprises a permeable peripheral portion and a hollow central core or chamber. Preferably, the second hollow tubular segment comprises fibrous filtration material. That is, preferably the permeable peripheral portion of the second hollow tubular segment comprises fibrous filtration material. The fibrous filtration material may comprise cellulose based fibers, such as cellulose acetate fibers. In such embodiments, the second hollow tubular segment may be understood to be a type of hollow acetate tube. By providing the second hollow tubular segment with a permeable peripheral portion, smoke can still flow through the segment, even if the chamber is filled with an impermeable insert unit. For example, if the chamber is provided with a frangible capsule, a consumer can still smoke the smoking article without breaking the capsule, since smoke can pass through the permeable peripheral portion. This provides the consumer with the ability to customise when to rupture the capsule during their smoking experience, rather than necessarily requiring them to rupture the capsule prior to smoking.

When the second hollow tubular segment comprises fibrous filtration material, a plasticiser may be added to the fibrous filtration material. Such plasticisers include triacetin, and triethylenglycol di-acetate. The plasticiser may be included in the second hollow tubular segment in an amount of from about 13 percent weight to about 25 percent weight of the total weight of the second hollow tubular segment.

Preferably, the first segment has a length in the longitudinal direction of the mouthpiece of from about 3 millimetres to about 10 millimetres, preferable about 4 millimetres to about 7 millimetres, most preferably about 5 millimeters. Such a length can help to ensure that the insert unit does not have to travel too far to reach the chamber, and therefore is not subjected to too high a compressive force for too long a duration as it passes through the opening.

If a second hollow tubular segment is provided, preferably, the second hollow tubular segment has a length of from about 4 millimetres to about 12 millimetres, preferable about 5 millimetres to about 10 millimetres, most preferably about 5 millimeters or 7 millimeters. This can allow the chamber to be sufficiently sized to accommodate at least two insert units, and in particular, at least two frangible flavour capsules. The ability to accommodate at least two insert units can provide the consumer with more degree of choice over how they customise their smoking article mouthpiece, since it allows the consumer to choose between different combinations of insert units.

It will be appreciated that, although the invention has been described above in respect of a smoking article, the advantages and technical effects of the invention are equally applicable to a mouthpiece for a smoking article. Consequently, according to a second aspect of the present invention, there is provided a mouthpiece for a smoking article, the mouthpiece being configured to receive an insert unit and comprising: a first segment of elastically deformable material, the first segment having a length in the longitudinal direction of the mouthpiece and a width transverse to its length, wherein the first segment comprises an insert unit access portion comprising at least one slit extending along at least a part of the length of the first segment, and extending across at least a part of the width of the first segment to facilitate deformation of the access portion, such that an opening is formable or expandable in the access portion of the first segment upon receiving an insert unit.

According to an aspect of the invention, there is provided a mouthpiece for a smoking article, the mouthpiece being configured to receive an insert unit and comprising: a first segment of elastically deformable material, the first segment having a length in the longitudinal direction of the mouthpiece and a width transverse to its length. The first segment comprises an insert unit access portion comprising at least one slit extending along at least a part of the length of the first segment, and extending across at least a part of the width of the first segment to facilitate deformation of the insert unit access portion, between: an undeformed state, in which the boundary of the at least one slit does not define an opening in the insert unit access portion; and a deformed state, in which the boundary of the at least one slit defines at least a portion of the periphery of an opening in the insert unit access portion upon receiving an insert unit.

It will be appreciated that the invention also relates to a method of forming a mouthpiece for a smoking article. Consequently, according to a third aspect of the present invention, there is provided a method of forming a mouthpiece for a smoking article, the method comprising: providing a first segment of elastically deformable material, the first segment having a length in the longitudinal direction of the mouthpiece and a width transverse to its length; and forming an access portion in the first segment, the access portion comprising at least one slit extending along at least a part of the length of the first segment, and extending across at least a part of the width of the first segment to facilitate deformation of the access portion, such that an opening is formable or expandable in the access portion of the first segment upon receiving an insert unit.

According to an aspect of the invention, there is provided a method of forming a mouthpiece for a smoking article that is configured to receive an insert unit, the method comprising: providing a first segment of elastically deformable material, the first segment having a length in the longitudinal direction of the mouthpiece and a width transverse to its length; and providing at least one slit in the first segment to form an access portion in the first segment, the at least one slit extending along at least a part of the length of the first segment, and extending across at least a part of the width of the first segment to facilitate deformation of the insert unit access portion, between: an undeformed state, in which the boundary of the at least one slit does not define an opening in the insert unit access portion; and a deformed state, in which the boundary of the at least one slit defines at least a portion of the periphery of an opening in the insert unit access portion upon receiving an insert unit.

Preferably, in the method of the third aspect of the present invention, the first segment is a hollow tubular segment of elastically deformable material having a pre-formed opening that forms part of the access opening, and wherein the at least one slit extends across at least a part of the width of the first segment from a point on the periphery of the pre-formed opening. Preferably, the step of forming an access portion in the first segment comprises applying at least one cut line to the first segment to form the at least one slit.

It will be appreciated that preferred features described above in relation to the first aspect of the invention may also be applicable to each of the second and third aspects of the invention.

The terms "upstream" and "downstream" refer to relative positions of elements of the smoking article or mouthpiece described in relation to the direction of mainstream smoke as it is drawn from the aerosol generating substrate and through the filter or mouthpiece. It will be appreciated that the term "expanded" is used herein to refer to the fact that an existing space or opening is extended into another part of the first segment by virtue of insertion of the insert unit and the at least one slit, with said space then typically becoming filled by at least a portion of the insert unit. This may or may not result in the deformable material of the first segment at least temporarily occupying a smaller overall volume of space. For example, the deformable material may simply be deflected about the boundaries of the at least one slit to create the additional space for the insert unit to occupy as it is being inserted into the first segment.

As used herein, the term "longitudinal" refers to a direction parallel to the length of the aerosol-generating article.

Smoking articles according to the present invention may be filter cigarettes or other smoking articles in which an aerosol-generating substrate comprises a tobacco material that is combusted to form smoke. Therefore, in any of the embodiments described above, the aerosol-generating substrate may comprise a tobacco rod. Furthermore, in any of the embodiments described above, the mouthpiece may be a filter. In such embodiments, the filter may be secured to the tobacco rod by a tipping paper.

Alternatively, smoking articles according to the present invention may be articles in which a tobacco material is heated to form an aerosol, rather than combusted. In one type of heated aerosol-generating article, a tobacco material is heated by one or more electrical heating elements to produce an aerosol. In another type of heated aerosol-generating article, an aerosol is produced by the transfer of heat from a combustible or chemical heat source to a physically separate tobacco material, which may be located within, around or downstream of the heat source. The present invention further encompasses aerosol-generating articles in which a nicotine-containing aerosol is generated from a tobacco material, tobacco extract, or other nicotine source, without combustion, and in some cases without heating, for example through a chemical reaction The invention will now be further described, by way of example only, with reference to the accompanying drawings in which:

Figure 1:
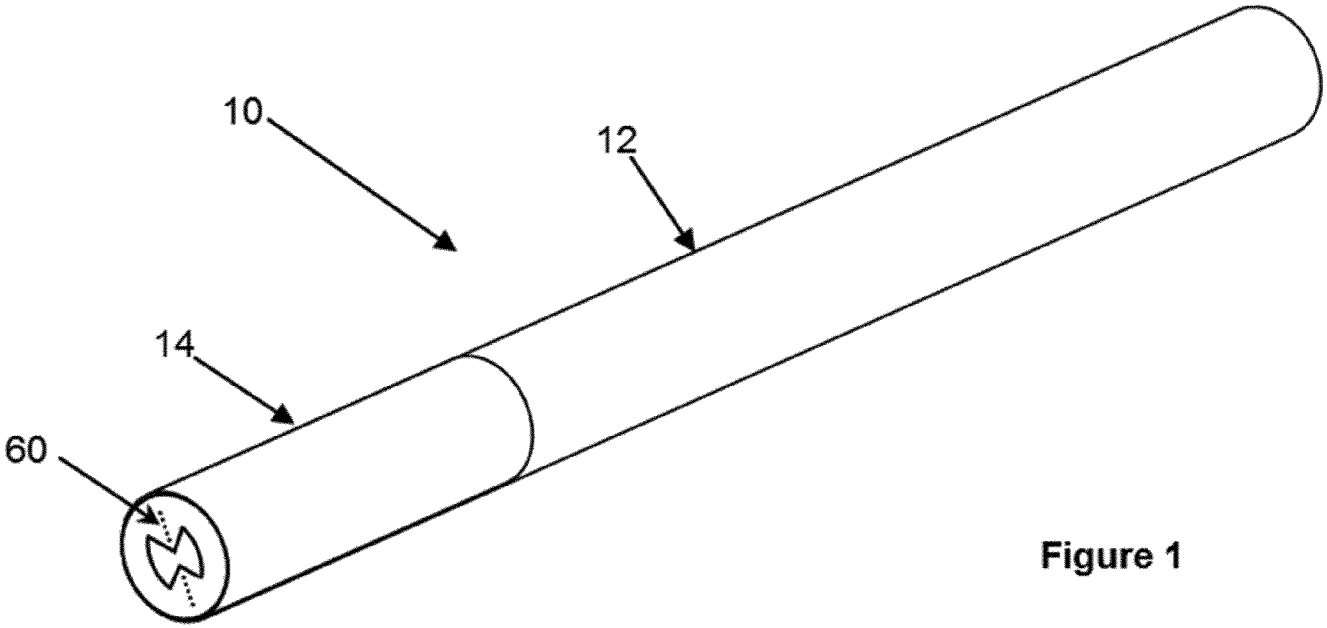
FIG. 1 shows a smoking article in accordance with the present invention.
Figure 2:
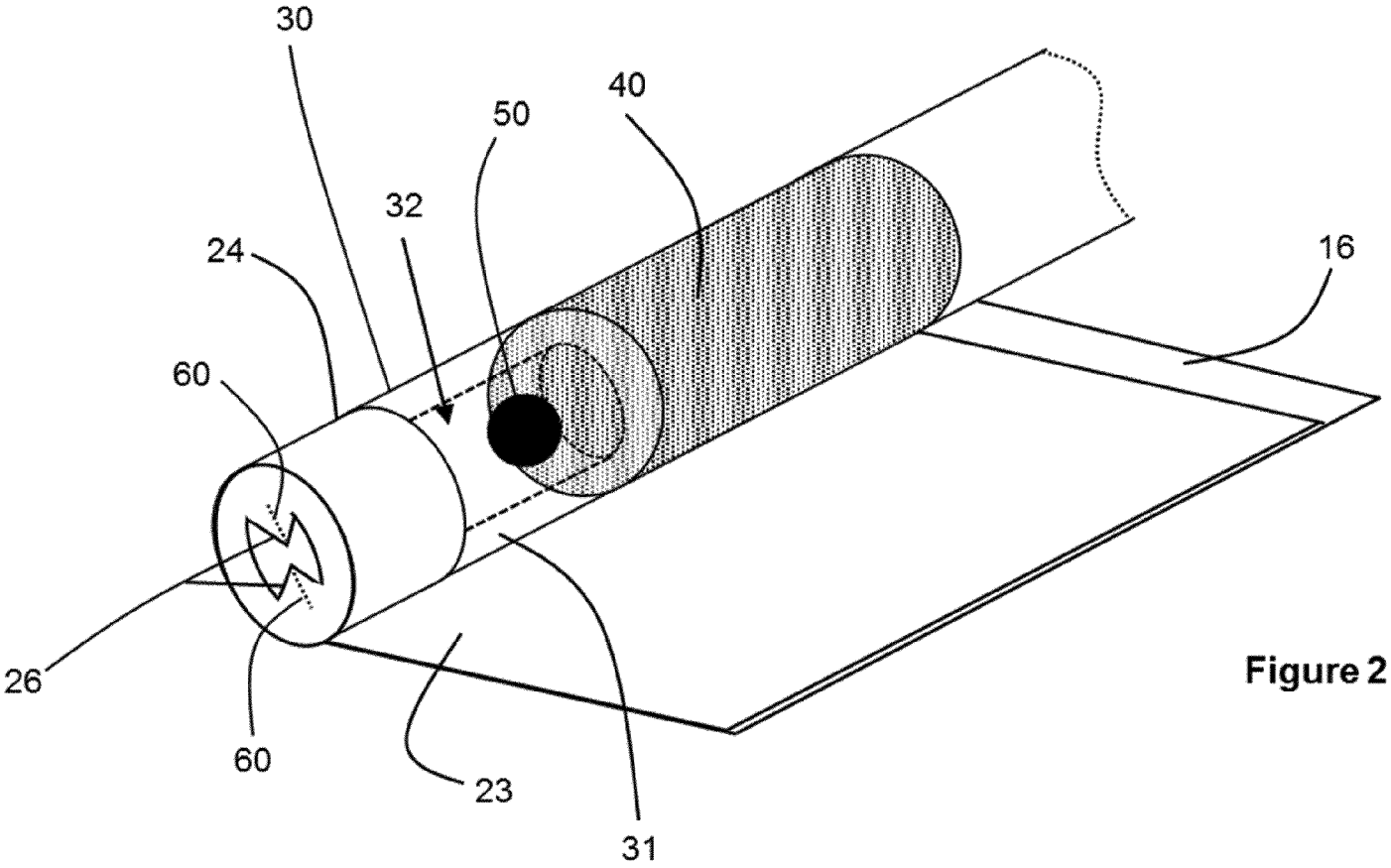
FIG. 2 shows a partially transparent view of the smoking article of FIG. 1 with the filter unwrapped.

FIGS. 1 and 2 illustrate a smoking article 10 in accordance with an embodiment of the present invention. The smoking article 10 comprises a wrapped rod 12 of tobacco cut filler which is attached at one end to an axially aligned filter 14. A band of tipping paper 16 circumscribes the filter 14 and a portion of the wrapped rod 12 of tobacco to join together the two portions of the smoking article 10.

As shown in FIG. 2, the filter 14 comprises a first segment 24, in the form of a hollow tubular segment. The first segment 24 comprises a permeable peripheral portion formed of elastically deformable fibrous filtration material (such as cellulose acetate tow), and a pre-formed central opening 25, which extends along the entire length of the segment 24.

In the FIG. 2 smoking article, the first segment 24 is at the downstream end of the filter 14. However, in some cases the filter can include one or more further hollow tubular segments downstream of the first hollow tubular segment. Alternatively or additionally, the portion downstream of the first segment may consist of a mouth end cavity formed by one or more wrappers extending downstream of the first hollow tubular segment.

Upstream of the first segment 24 is a second hollow tubular segment 30, also formed of fibrous filtration material, such as cellulose acetate tow. The second hollow tubular segment 30 has a peripheral portion 31 formed of fibrous filtration material, such as cellulose acetate tow. As seen in FIG. 2 the second hollow tubular segment 30 is adjacent to the first segment 24.

Figure 3:
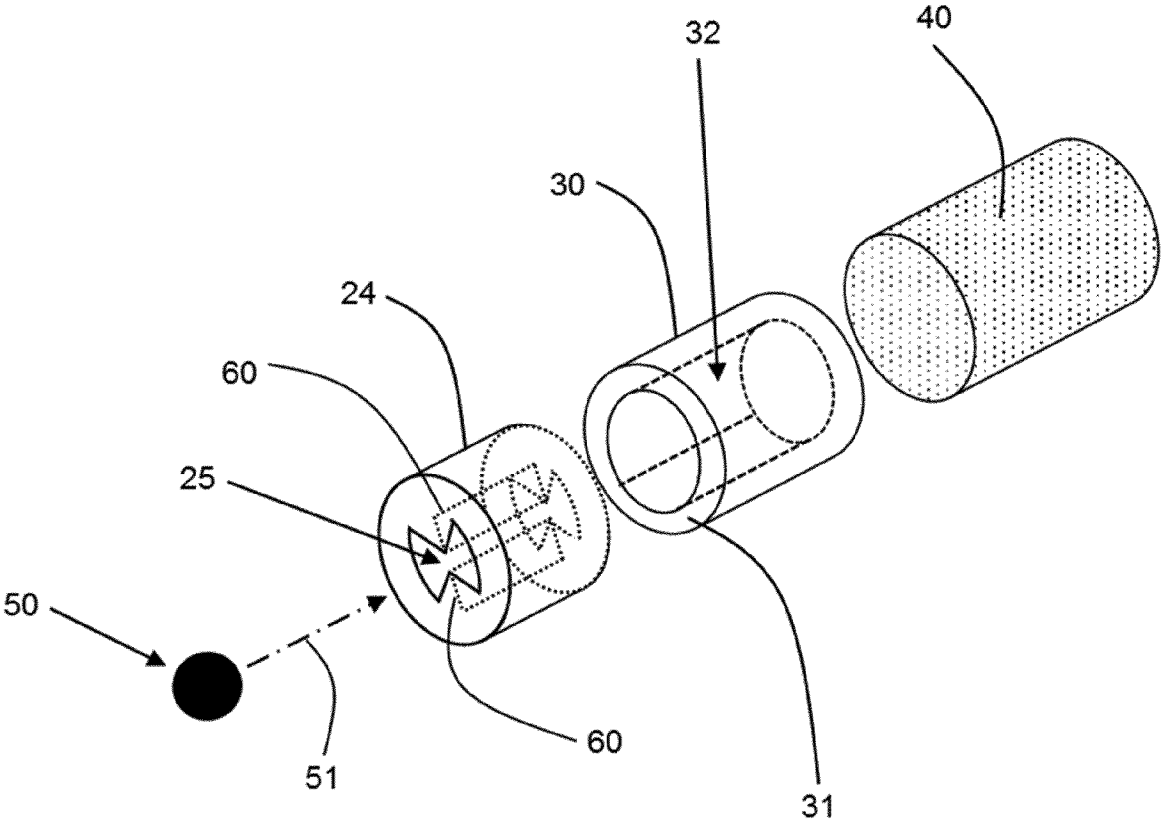
FIG. 3 shows an exploded view of some of the components of FIG. 2.

The second hollow tubular segment 30 defines a chamber 32 for receiving an insert unit 50, such as a capsule 50. Adjacent to and upstream of the second hollow tubular segment 30 is a plug of filtration material 40, such as a plug of cellulose acetate tow. An exploded view of the a first hollow tubular segment 24, second hollow tubular segment 30 and plug of filtration material 40 can be seen in FIG. 3. In FIG. 2, the capsule 50 is shown as being in the chamber 32 of the second hollow tubular segment 30. In FIG. 3, the capsule 50 is shown as being external to the mouthpiece segments, with an arrow 51 indicating the path along which the capsule must travel to enter the chamber 32 of the second hollow tubular segment 30.

As can be best seen from FIGS. 2 and 3, the first segment 24 comprises an insert unit access portion, which comprises the pre-formed opening 25 and a pair of slits 60. The access portion is provided in this way so that an insert unit 50 can pass from the exterior of the mouthpiece into the chamber 32 of the second hollow tubular segment 30. In particular, as best seen from FIG. 3, two portions of the first hollow tubular segment 24 inwardly project into the pre-formed opening 25 to define two elastically deformable projections 26 at the downstream end of the filter 14. These projections help to reduce the cross sectional area of the pre-formed opening 25 relative to the cross sectional area of the chamber 32.

Each slit 60 of the access portion extends along the entire length of the first segment 24, and across a portion of the width of the first segment 24 from a point on the periphery of the pre-formed opening 25 defined by the tip of a respective elastically deformable projection 26. The slits 60 are provided in this way to facilitate deformation of the access portion of the first segment 24, so that the pre-formed opening 25 can be expanded in the access portion when the insert unit is being passed through the first segment 24.

The slits 60 may be formed by applying a cutting blade to the first segment 24 after the opening 25 has been formed.

By providing the slits 60 in the first segment, the capsule 50 can be easily inserted into the mouthpiece 14 without a great risk of damaging the capsule 50 during insertion. This is because the slits 60 can help the access portion of the first segment 24, and in particular the projections 26 of the first segment 24, to better deform about the pre-formed opening 25 as the capsule 50 passes through the first segment 24. This prevents the elastically deformable material of the first segment 24 from imposing too large a resistive or compressive force on the capsule 50. However, once the capsule 50 has passed through the pre-formed opening 25 and resides in the chamber 32 of the second hollow tubular element 30, the first segment 24, and in particular the projections 26, can elastically revert to a previous undeformed state to provide a barrier that prevents or inhibits the capsule 50 from exiting the mouthpiece 14. In particular, the first segment 24 can elastically revert to a position that results in the pre-formed opening 25 of the first segment having a cross-section area that does not fully encompass the cross sectional area of the capsule 50 contained within the chamber 32. Namely, after the capsule 50 has passed through the first segment 24, the portion of the first segment 24 defined by the slits 60 reverts to its previous position such that the slits 60 exhibits their previous narrow profile and thus ensure there is at least a partial enclosure surface downstream of the chamber 32 to secure the capsule 50 in the chamber 32. Consequently, the capsule 50 is retained within the chamber 32 and prevented from exiting the mouthpiece 13.

Accordingly, a consumer can insert the capsule 50, through the access portion of the first segment 24, and into the chamber 32 of the second hollow tubular segment 30. During insertion, the projections 26 elastically deform to allow passage of the insert unit 50 through the opening 25. Deformation of the projections 26 is further facilitated by the presence of the slits 60. After the capsule 50 has passed into the chamber 32, the projections 26 revert to their previous (undeformed) state and provide a barrier that prevents the capsule 50 from exiting the mouthpiece.

Figure 6:
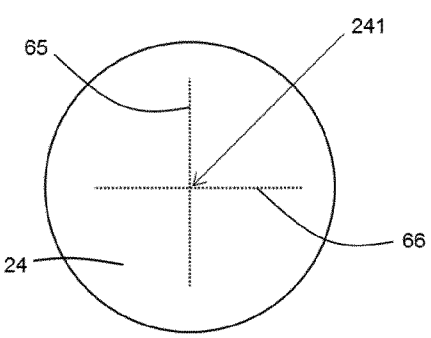
FIGS. 4 to 6 show exemplary configurations for the first segment of a smoking article in accordance with various different embodiments of present invention.
Figure 5:
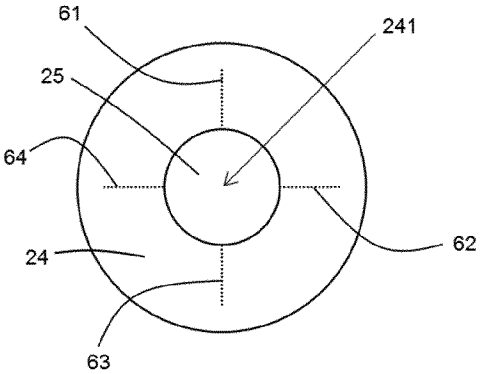
Figure 4:
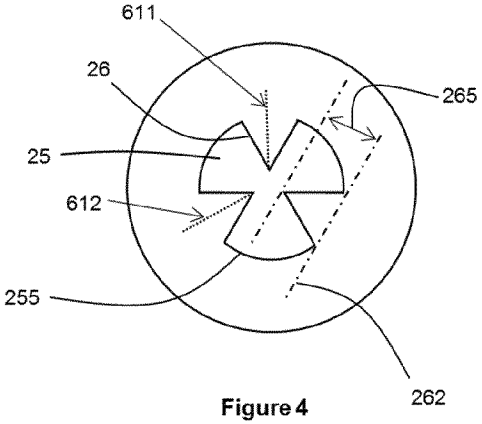

FIGS. 4 to 6 show exemplary configurations for the access portion of the first segment 24 of a smoking article in accordance with embodiments of present invention, as viewed from the downstream end of the smoking article at a point along the central longitudinal axis of the smoking article. In FIG. 4, the access portion again comprises a pre-formed opening 25. There are three elastically deformable projections 26 uniformly disposed around the pre-formed opening 25, with each projection 26 being disposed at the tip of an imaginary equilateral triangle. That is, the projections 26 are equally spaced around the pre-formed opening 25.

As shown in FIG. 4, the access portion of the first segment further comprises a first slit 611 and a second slit 612, each extending from the tip of a respective projection 26. One of the projections has no corresponding slit.

As can be seen from FIG. 4, the pre-formed opening 25 has a perimeter 255 as viewed from the downstream end of the smoking article. Each projection 26 of the first hollow tubular segment 24 is delimited by a first portion of the perimeter and an imaginary straight line 262 that interests each end of the first portion of the perimeter. The distance 265 between the straight line 262 and the point on the first portion of the perimeter furthest from the straight line in a direction perpendicular to the straight line corresponds to the 'height' 265 of the projection 26.

FIGS. 5 and 6 shows further exemplary configurations for the access portion of the first segment 24 of a smoking article in accordance with embodiments of present invention. In FIG. 5, the access portion again comprises a pre-formed opening 25. However, in this embodiment, no projections are provided around the pre-formed opening 25 of the access portion of the first segment 24. Instead, the pre-formed opening 25 has a circular cross section. The access portion of the first segment 24 in FIG. 5 also comprises four slits 61, 62, 63, 64, which are equally spaced around the pre-formed opening 25. Each slit extends across a portion of the width of the first segment 24 from a point on the periphery of the pre-formed opening 25, and along the path of a line passing through the centre 241 of the first segment's 24 substantially circular cross-section. In the embodiment of FIG. 5, the cross section of the pre-formed opening 25 is smaller than the cross section of the insert unit 50, which is inserted into the mouthpiece. In such a scenario, the elastically deformable material of the first segment 24 could be expected to provide a relatively large compression force on the insert unit 50 as it passes through the pre-formed opening 25. However, because the access portion includes four slits 61, 62, 63, 64 spaced around the pre-formed opening 25, deformation of the access portion can be further facilitated. This helps to prevent the elastically deformable material of the first segment 24 from imposing too large a resistive or compressive force on the insert unit 50, as the unit 50 is being inserted into or through the access portion of the first segment.

FIG. 6 shows a further exemplary configuration for the first segment 24 of a smoking article in accordance with another embodiment of present invention. Unlike the segments of FIGS. 4 and 5, the access portion of the first segment in FIG. 6 does not comprise a pre-formed opening 25. Instead, the access portion of the first segment in FIG. 6 is defined solely by a first slit 65, and a second slit 66. The second slit 66 is substantially perpendicular to the first slit 65. Each slit extends across a portion of the width of the first segment 24, and along the path of a line passing through the centre 241 of the first segment's 24 substantially circular cross-section. Accordingly, when the access portion of the first segment 24 in FIG. 6 is its undeformed state, there is effectively no opening in the access portion or an infinitesimally small sized opening defined solely by the slits 65, 66 themselves. However, when a consumer attempts to insert an insert unit 50 into the mouthpiece via the access portion of the first segment 24, the slits 65, 66 facilitate deformation of the access portion about the insert unit 50 to cause an opening to be formed in the access portion, and thus allow the insert unit 50 to pass at least partially through the first segment 24 without imposing too large a resistive or compressive force on the insert unit 50.

After the insert unit 50 has passed sufficiently far along the length of the access portion of the first segment 24, the portions of the slits 65, 66 at the mouth end of the first segment 24 will no longer be affected by the presence of the insert unit, and can therefore revert to their previous undeformed state. This means that the slits 65, 66 exhibits their previous narrow profile as shown in FIG. 6, and thus ensure there is at least a partial enclosure surface downstream of the insert unit 50. The mouth end portions of the slits 65, 66 can therefore provide an extremely effective barrier that prevents or inhibits the insert unit 50 from exiting the mouthpiece, after it has been inserted.

The invention claimed is:

1. A smoking article for receiving an insert unit, the smoking article comprising:

an aerosol-generating substrate and a mouthpiece secured to a downstream end of the aerosol-generating substrate, the mouthpiece comprising:

a first segment of elastically deformable material, the first segment having a length in a longitudinal direction of the mouthpiece and a width transverse to its length, wherein the first segment comprises an insert unit access portion comprising at least one slit extending along at least a part of the length of the first segment, and extending across at least a part of the width of the first segment to facilitate deformation of the insert unit access portion, between:

an undeformed state, in which the boundary of the at least one slit does not define an opening in the insert unit access portion; and a deformed state, in which the boundary of the at least one slit forms at least a portion of the periphery of an opening in the insert unit access portion by action of inserting an insert unit into the first segment of the mouthpiece.

2. The smoking article according to claim 1, wherein the access portion of the first segment consists solely of the at least one slit.

3. The smoking article according to claim 1, wherein the first segment is a hollow tubular segment of elastically deformable material and the access portion of the first segment further comprises a pre-formed opening in the hollow tubular segment, and wherein the at least one slit extends across at least a part of the width of the first segment from a point on the periphery of the pre-formed opening.

4. The smoking article according to claim 3, wherein at least a portion of the first hollow tubular segment inwardly projects into the pre-formed opening to define at least one elastically deformable projection.

5. The smoking article according to claim 4, wherein the at least one slit extends across at least a part of the width of the first segment from a point on the periphery of the pre-formed opening defined by the tip of the at least one elastically deformable projection.

6. The smoking article according to claim 1, wherein the first segment has a substantially circular cross-section and the at least one slit extends along at least a portion of a line passing through the centre of the first segment's substantially circular cross-section.

7. The smoking article according to claim 1, wherein the at least one slit in the first segment comprises a first slit and a second slit, and wherein the first slit intersects with the second slit at a location on the first segment.

8. The smoking article according to claim 7, wherein the second slit is substantially perpendicular to the first slit.

9. The smoking article according to claim 1, wherein the at least one slit extends along the entire length of the first segment.

10. The smoking article according to claim 1, wherein the first segment comprises fibrous filtration material, such as cellulose acetate fibers, polylactic acid fibers or crimped paper, and a plasticiser added to the fibrous filtration material.

11. The smoking article according to claim 1, wherein the mouthpiece further comprises a second segment adjacent to and upstream of the first segment, and wherein the second segment is a hollow tubular segment defining a chamber for receiving the insert unit.

12. The smoking article according to claim 11, wherein the mouthpiece further comprises a segment of filtration material adjacent to and upstream of the second segment.

13. A mouthpiece for a smoking article, the mouthpiece being configured to receive an insert unit and comprising:

a first segment of elastically deformable material, the first segment having a length in a longitudinal direction of the mouthpiece and a width transverse to its length, wherein the first segment comprises an insert unit access portion comprising at least one slit extending along at least a part of the length of the first segment, and extending across at least a part of the width of the first segment to facilitate deformation of the insert unit access portion, between:

an undeformed state, in which the boundary of the at least one slit does not define an opening in the insert unit access portion; and a deformed state, in which the boundary of the at least one slit forms at least a portion of the periphery of an opening in the insert unit access portion by action of inserting an insert unit into the first segment of the mouthpiece.

14. A method of forming a mouthpiece for a smoking article that is configured to receive an insert unit, the method comprising:

providing a first segment of elastically deformable material, the first segment having a length in a longitudinal direction of the mouthpiece and a width transverse to its length; and providing at least one slit in the first segment to form an access portion in the first segment, the at least one slit extending along at least a part of the length of the first segment, and extending across at least a part of the width of the first segment to facilitate deformation of the insert unit access portion, between:

an undeformed state, in which the boundary of the at least one slit does not define an opening in the insert unit access portion; and a deformed state, in which the boundary of the at least one slit forms at least a portion of the periphery of an opening in the insert unit access portion by action of inserting an insert unit into the first segment of the mouthpiece.

15. The method according to claim 14, wherein the first segment is a hollow tubular segment of elastically deformable material having a pre-formed opening that forms part of the access opening, and wherein the at least one slit extends across at least a part of the width of the first segment from a point on the periphery of the pre-formed opening.

* * * * *